United States Patent [19]

Schrank

[11] Patent Number: 4,618,802

[45] Date of Patent: Oct. 21, 1986

[54] HERMETICALLY SEALED ENCLOSURE FOR THIN FILM DEVICES

[75] Inventor: Martin P. Schrank, Ipswich, Mass.

[73] Assignee: GTE Products Corporation, Danvers, Mass.

[21] Appl. No.: 665,896

[22] Filed: Oct. 29, 1984

[51] Int. Cl.[4] ..... H05B 33/04

[52] U.S. Cl. ..... 313/512; 445/25

[58] Field of Search ..... 313/512; 445/25

[56] References Cited

U.S. PATENT DOCUMENTS

| | | | |
|---|---|---|---|
| 3,320,459 | 5/1967 | Stone | 313/512 |
| 3,330,982 | 7/1967 | Dickson, Jr. | 313/512 X |
| 3,524,234 | 8/1970 | Dickson, Jr. et al. . | |
| 3,665,238 | 5/1972 | Esdonk et al. | 445/25 X |

*Primary Examiner*—Palmer C. DeMeo

*Attorney, Agent, or Firm*—José W. Jimenez

[57] ABSTRACT

A hermetically sealed enclosure for a thin film device, such as an electroluminescent device, in which the device includes a thin film matrix supported on a glass substrate. The glass substrate is mounted in a frame and a frit seal is provided between the glass substrate and the frame. A cover is also secured and sealed to the frame by a weld or solder joint. The integrity of both the substrate to frame seal and the frame to cover seal is preserved by forming the surfaces bounding each seal out of materials having substantially similar coefficients of thermal expansion. Since the rates of expansion will be similar, the seals should not develop weaknesses throughout the life of the device over a range of temperatures.

8 Claims, 5 Drawing Figures

HERMETICALLY SEALED ENCLOSURE FOR THIN FILM DEVICES

CROSS REFERENCE TO CO-PENDING APPLICATION

In copending U.S. patent application Ser. No. 756,560 ("Electroluminescent Display," Hidler et al.), which is a continuation application of U.S. Ser. No. 431,954, now abandoned, there is defined a hermetic seal formed by an electrically insulative thin film layer disposed over conductive thin film leads, and metallic solder means over the insulative layer to provide a bond between a cover sheet and a base substrate.

TECHNICAL FIELD

The present invention relates in general to thin film devices and, more particularly, to an improved hermetically sealed enclosure for thin film devices such as thin film electroluminescent devices.

BACKGROUND

It is known that thin film devices are generally quite sensitive to adverse environmental conditions. For example, humidity is one parameter in particular which is instrumental in causing detrimental functioning of thin film devices. The optical and electrical characteristics of thin film devices can be changed by chemical interaction and by heating, which parameters also effect the maintenance problems associated with thin film devices. It is, therefore, necessary to seal the active thin film device hermetically before it can be placed into operation in any environment.

Presently employed conventional methods for providing hermetic seals do provide some protection for the thin film electroluminescent devices. However, there are certain limitations and shortcomings relative to these present methods. In particular, they all tend to interact directly with the device during the sealing process.

One means of forming a seal is with the use of plastic or epoxy materials. Plastic and epoxy seals are themselves waterproof to a certain degree. However, increased humidity combined with increased temperature causes softening of many of the plastics and in most cases they tend to delaminate from the glass surfaces. This action is usually preceded by a deterioration of the tin oxide or indium tin oxide electrodes when the device is operated under humid conditions. There are numerous plastic products and also one and two component epoxies that are presently in use but all tend to fail after several hundred hours of use, particularly in a humid environment.

A second group of seals are glass-to-metal seals. In some ways these are an improvement over plastic seals but require higher processing temperatures even when soft glass substrates are used. If hard glass substrates are utilized for thin film deposition, the frit glass sealing temperatures are beyond the tolerable limit for dark field devices. Even the soft glass frits are only within a few degrees (sealing temperature of 400° C.) of a point where the dark field characteristics change. The sealing temperature even for soft glass frits is at a temperature level where chemically absorbed water is desorbed, causing blistering and flaking of the thin film layers.

Another method of frit glass sealing is one in which a picture frame type layer of solder glass is screen printed and then fritted over the tin oxide layer of the thin film assembly. This sealing glass frame is then coated with nickel and can subsequently be soldered to a cover glass which is treated in the same fashion. Alternatively, an organo-metallic paint, such as silver-platinum, may be fired onto the sealing frame in place of the above-mentioned nickel. This process is carried out prior to any thin film deposition. The difficulty with this process is that the application is rather limited to relatively crude display devices because in the case of a dot matrix display, with pixels of only a few mils in size, the masking of the glass frame processed panels becomes virtually impossible.

It is believed, therefore, that an improved hermetically sealed enclosure for a thin film device which not only provides for proper sealing, but allows the device to operate for extended periods of time, under rugged conditions if necessary, would be deemed a significant advancement in the art.

SUMMARY OF THE INVENTION

Accordingly, it is a primary object of the present invention to provide a new and improved hermetic seal for a thin film device such as an electroluminescent device.

It is another object of the present invention to provide a hermetically sealed enclosure for a thin film device in which the above-mentioned shortcomings are eliminated and in which the sealing techniques do not interfere with the characteristics of the thin film device.

It is still another object of the present invention to provide an improved technique for hermitically sealing a thin film device in which the sealing operation is carried out without requiring elevated temperatures and in which the sealing operation itself may be carried out in any desired atmosphere including even a vacuum atmosphere.

In accordance with one aspect of the instant invention, there is provided a hermetically sealed enclosure for a thin film device. The enclosure comprises frame means, a light-transmitting, electrically insulating substrate, having a thin film matrix positioned on one side thereof, the substrate being in contact with the frame means and made of a material that has a coefficient of thermal expansion substantially similar to the material forming the frame means. The enclosure also includes hermetic seal means adjacent the substrate and in contact with the frame means and a pair of electrical conductors electrically coupled to the thin film matrix. The enclosure further includes cover means hermetically sealed to the frame means, the cover means, frame means and substrate defining a chamber therebetween wherein the thin film matrix is located, the cover means supporting the conductors extending therethrough.

In accordance with another aspect of the present invention there is provided a method of hermetically sealing a thin film device. The sealing method comprises the steps of providing frame means and sealing a light transmitting, electrically insulating substrate having a thin film matrix positioned on one side of the substrate to the frame means to form a hermetic seal. The substrate is made of a material having a coefficient of thermal expansion substantially similar to the material forming the frame means. The method further includes securing cover means to the frame means, thereby electrically coupling a pair of electrical conductors to the thin film matrix, which conductors extend from and are supported by the cover means. The cover means, frame means and substrate define a chamber therebetween, the thin film matrix being located within the chamber. The method further includes the step of hermetically sealing the cover means to the frame means.

In accordance with still another aspect of the present invention, there is provided a method of hermetically sealing a thin film device. The sealing method comprises the steps of: providing frame means and sealing a plate to frame means to form a hermetic seal. Disposing a light transmitting, electrically insulating substrate having indentations formed therein in contact with frame means; the substrate being made of a material having a coefficient of thermal expansion substantially similar to the material forming frame means. A thin film matrix if formed on the side of the substrate having the indentations, the thin film matrix having conductive contacts extending therefrom and into a respective one of the indentations, the indentations then being filled with a conductive adhesive. The method further includes securing cover means to frame means, cover means having a pair of electrical conductors extending therefrom and into the conductive adhesive upon securing cover means. The cover means, frame means and substrate define a chamber therebetween, the thin film matrix being located within the chamber. The method further includes heating said conductive adhesive for a predetermined period of time at a predetermined temperature thereby curing the adhesive and fixedly joining the contacts and conductors. The method includes the final step of hermetically sealing the cover means and the frame means together.

BEST MODE FOR CARRYING OUT THE INVENTION

For a better understanding of the present invention together with other and further objects, advantages and capabilities thereof, reference is made to the following disclosure and appended claims in conjunction with the above described drawings.

Figure 1A:
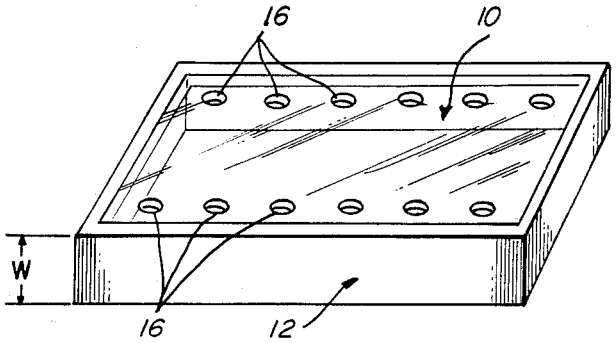
FIG. 1A is a perspective view showing an initial step in the construction of the hermetically sealed enclosure of the present invention having a glass substrate and one example of an associated frame means.
Figure 1B:
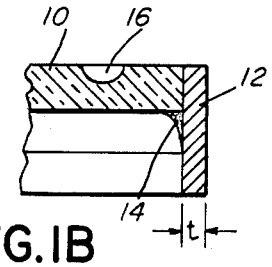
FIG. 1B is a partial, cross-sectional view illustrating the glass substrate, the frame means and the formation of a frit seal for joining the substrate and frame means.

Referring now to the drawings, and in particular to FIGS. 1A and 1B, there is shown a substrate 10 which is of rectangular shape. Substrate 10 is supported in a rectangular frame 12 and is dimensioned so as to snugly fit within frame 12. Frame 12 is preferably of a metallic material that has a coefficient of thermal expansion substantially similar to the material forming substrate 10. Such a matching of expansion coefficients will result in a seal that will not develop any weaknesses or cracks, over the life of the thin film device, caused by different rates of expansion over a wide range of temperatures. Frame 12 is frit sealed, as illustrated by the glass frit seal 14 in FIG. 1B, to substrate 10. In this particular example, the substrate is made of a light-transmitting, electrically insulating substance such as borosilicate glass (such as the type 7059, which is a glass produced by Corning Glass Works, Corning, New York). Seal 14 is formed on the inner surface of frame 12.

The thickness "t" of frame 12 is preferably at least 0.015 inch. The thickness is actually preferably greater than the thickness mentioned above so as to dissipate the heat that is generated during the final soldering or welding step. In one embodiment a frame having a thickness "t" on the order of 0.027 inch was used. In addition, the width "w" of frame 12 was in the range of about 0.187 inch to 0.25 inch.

Thus, as illustrated in FIGS. 1A and 1B, there is initially provided a substrate 10 that is frit sealed to frame 12. As indicated previously, frame 12 is preferably of a metallic material and thus is solderable or weldable. As also illustrated in FIG. 1A, substrate 10 and frame 12 are secured in a position wherein substrate 10 is preferably flush at its top surface with the top of frame 12. In an alternate version the frame may be dropped a few mils relative to substrate 10 so that substrate 10 protrudes slightly above the top edge of frame 12. In either case, the device as assembled to the extent illustrated in FIGS. 1A and 1B may now be coated with the entire thin film stack or matrix, including a dark field and aluminum contacts.

Figure 2:
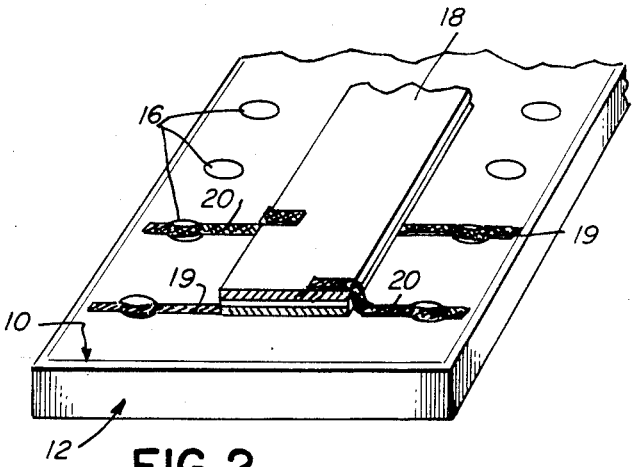
FIG. 2 is a perspective view illustrating a glass substrate having a thin film matrix with conductive contacts extending therefrom.

Prior to any coating operation, a series of shallow semispherical indentations 16 are formed in glass substrate 10 (see FIG. 1A) by ulstrasonic dimpling. Indentations or dimples 16 have a depth in the range of about 0.010 inch to 0.015 inch. With reference to FIG. 2, indentations 16 are provided at those positions where subsequently tin oxide or aluminum contacts, which extend from a thin film matrix 18 deposited on substrate 10, are to be formed. During the coating operation, some of the indentations 16 will be overcoated with tin oxide, to form tin oxide contacts 19, while others will be coated with aluminum, to form aluminum contacts 20 that extend from the top of thin film matrix 18 to the respective indentation. In this particular embodiment, matrix 18 is for an electroluminescent device so that a portion of the phosphor layer of matrix 18 that is bounded by an addressed tin oxide contact and an addressed aluminum contact will be activated. Finally, a dark field layer may be deposited over matrix 18 to enhance visibility of the activated phosphor layer, by creating a dark field effect, due to the increase in contrast.

Figure 3:
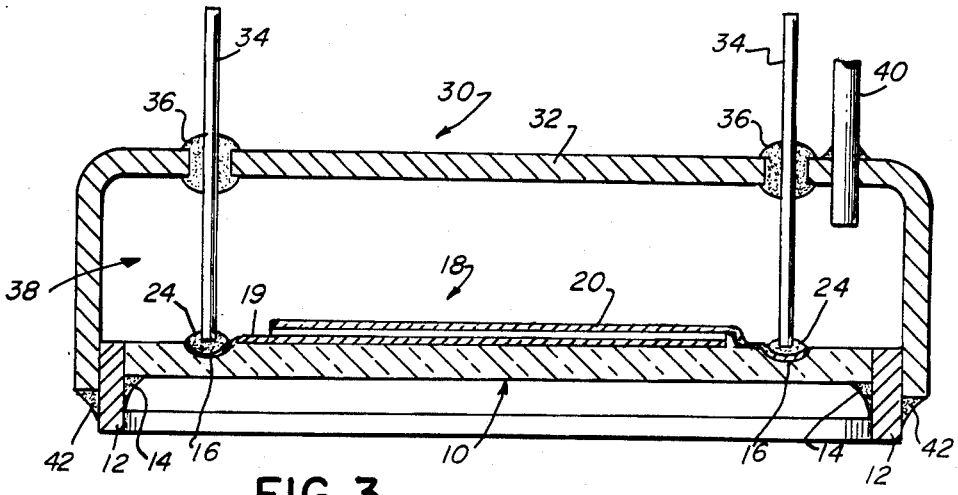
FIG. 3 is a cross-sectional view illustrating one embodiment of a hermetically sealed enclosure.

At the end of the thin film deposition steps, indentations 16 are filled with tiny droplets or beads of a conductive adhesive that overlie contacts 19 and 20. One example of these droplets is illustrated in FIG. 3 by the numeral 24. The conductive adhesive is preferably a one compound, non-solvent containing, conductive epoxy. One epoxy that has been used is Epo-tek H31 ("Epo-tek" is a trademark of Epoxy Technology, 14 Fortune Drive, Billerica, Mass). There are also equivalent conductive epoxies that are also suitable (available from a supplier such as Hanovia Engelhard). The described conductive epoxy will set when heated to a temperature in the range of about 120° to 150° Celsius for about 30 to 60 minutes. If lower temperatures than 150° Celsius are used, then the setting (curing) time is longer. These conductive epoxies do not outgas at temperatures up to 190° Celsius. Their vapor pressure is, under these conditions, in the order of about $10^{-7}$ to $10^{-8}$ Torr. The dispensing of tiny droplets 24 can be carried out in either a vacuum or in room air.

FIG. 3 illustrates one embodiment of the completed sealed enclosure made in accordance with the teachings of the present invention. In addition to frame 12 and substrate 10, there is provided a cover means 30. The cover means and frame are preferably made of the same material. Cover means such as cover means 30 are commercially available from such companies as Air Pax of Cambridge, Maryland or from Reeves and Hoffman of Carlisle, Pennsylvania. Cover means 30 has solid side walls that support electrical conductors (or feedthroughs) extending therethrough. In FIG. 3 the electrical conductors are illustrated by conductors 34, each of which may be glass fritted to cover means 30 through wall 32 as illustrated at 36. Cover means 30 is secured and sealed to frame 12 to form a cover means to frame seal at 42 that lies on the outer surface of frame 12. Seal 42 may be a solder or weld joint that seals off the thin film device. The portion of each of conductors 34 located within a chamber 38 is affixed to glass substrate 10 by conductive adhesive 24 disposed within indentations 16. Conductors 34 are self-aligning with conductive contacts 19 and 20 when cover means 30 is secured to frame 12. Chamber 38 is defined by the combination of substrate 10, frame 12 and cover means 30. Matrix 18 is located within chamber 38 on the side of substrate 10 having indentations 16 and is electrically coupled to conductors 34 at conductive contacts 19 and 20.

FIG. 3 also illustrates a relatively small exhaust pipe 40 extending through wall 32 of cover means 30. Pipe 40 may be in the form of a Rodar ("Rodar" is a trademark of GTE Sylvania, Danvers, Mass) or soft nickel tube. Pipe 40 can be either fritted in at the same time that electrical conductors 34 are glass fritted, or alternatively, pipe 40 can be secured to cover means 30 by soldering.

Figure 4:
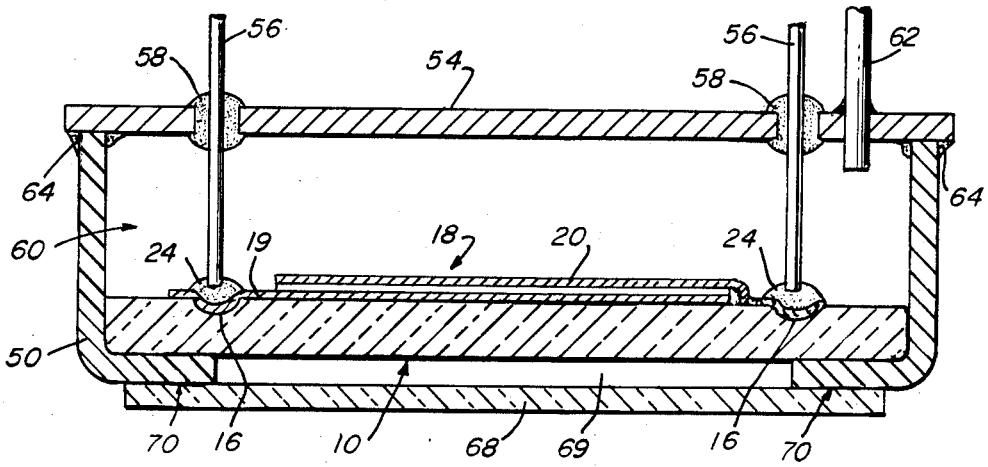
FIG. 4 is a cross-sectional view illustrating another embodiment of a hermetically sealed enclosure.

FIG. 4 illustrates another embodiment of the completed sealed enclosure made in accordance with the teachings of the present invention. In this particular embodiment of the invention, the commercially available cover means described earlier can serve as a frame, frame 50, for supporting substrate 10. As illustrated in FIG. 4, a portion of the wall of frame 50 is cut out, in order to create a window 69, to allow for viewing of matrix 18 on substrate 10. Before placing substrate 10 in frame 50, a glass plate 68 is frit sealed by seal 70, over window 69, to frame 50 in order to protect an exposed portion of substrate 10 from dust or an external impact. Substrate 10, as described before, has indentations 16, thin film matrix 18, conductive contacts 19 and 20 and epoxy droplets 24 disposed in indentations 16. Frame 50, cover means 54, and plate 68 (along with seals 58, 64 and 70) in combination help to define a hermetically sealed enclosure for matrix 18. In order to ensure the integrity and long life of seal 70, the two surface bounding seal 70 should have similar rates of expansion over a wide range of temperatures. Therefore, the materials used for frame 50 and glass plate 68 should have coefficients of thermal expansion that are substantially similar. In this embodiment, frame 50 is made of Rodar and plate 68 is made of borosilicate glass (Corning #7059 type). Due to the similar rates of expansion, seal 70 should not be weakened during the life of the device.

Cover means 54, which is preferably made of a metallic material similar to that of frame 50, is secured to frame 50. Cover means 54 supports electrical conductors 56 that extend through it. Conductors 56 are glass fritted (or epoxied) to cover means 54 as illustrated at 58. The portion of conductors 56 located within a chamber 60 is affixed to substrate 10 by conductive adhesive 24 disposed within indentations 16. Conductors 56 are self-aligning with conductive contacts 19 and 20 when cover means 54 is secured to frame 50. Chamber 60 is defined by the combination of substrate 10, frame 50 and cover means 54. Matrix 18 is located within chamber 60 on the side of substrate 10 having indentations 16 and is electrically coupled to conductors 56 at conductive contacts 19 and 20. A small exhaust pipe 62, made in the form of a Rodar or soft nickel tube, extends through cover means 54. Pipe 62 is secured to cover means 54 by soldering or through the use of a glass frit. A weld or solder joint 64 is formed on the outer surface of frame 50 to complete sealing or enclosure for the thin film device.

A method of hermetically sealing the thin film devices described herein comprises the following steps. A frame 50 is first provided. Frame 50 is then sealed to plate 68 to form a hermetic seal 70. A light transmitting, electrically insulating substrate 10 having indentations 16 formed therein is then provided. Substrate 10 is made of a material having a coefficient of thermal expansion substantially similar to the material forming frame 50. A thin film matrix 18 is formed on the side of substrate 10 having indentations 16, matrix 18 having conductive contacts 19 and 20 extending therefrom and into a respective one of indentations 16 (see FIG. 4). Indentations 16 are then filled with a conductive adhesive 24. Cover means 54, having a pair of electrical conductors 56 extending therethrough, is then secured to frame 50. Conductors 56 are then lined up with epoxy droplets 24 and gently pressed into the droplets.

In the final steps, the thin film device is heated for about 30 minutes at a temperature of about 150° Celsius in order to cure the epoxy and fixedly join the conductors to the contacts on the substrate. During the curing process, the device may be flushed with inert gas through chamber 60 via pipe 62. Finally, cover means 54 and frame 50 are hermetically sealed together by welding or soldering; the weld or solder joint is illustrated as 64. After the final step of assembly, exhaust tube 40 is mechanically pinched off. During the assembly operation, the device can be placed within any desired atmosphere.

An alternative method of hermetically sealing a thin film device, where the thin film matrix is already formed on the substrate and there is not a need to align a great deal of electrical conductors while sealing the device, is described herein as comprising the following steps. A frame means is first provided wherein a light transmitting, electrically insulating substrate is to be frit sealed to frame means to form a hermetic seal. To ensure the integrity of the seal over a wide range of temperatures, the substrate and frame means are made of materials having substantially similar coefficients of thermal expansion. Cover means is provided and secured to frame means, thereby electrically coupling electrical conductors to the thin film matrix. The conductors extend from and are supported by cover means. The cover means is then hermetically sealed to frame means, by welding or soldering, to define an enclosed thin film device.

It is also to be noted that the cover means and the frame, which are preferably of Rodar and thus opaque, have an attendant advantage in its use: the cover functions additionally as a partially black body, thus augmenting the dark field effect. Suitable materials for forming the frame and cover means preferably have coefficients of thermal expansion that are in the range of about $45\times10^{-7}$ to $50\times10^{-7}$ centimeter/centimeter/-Celsius (cm/cm/°C.) in the temperature range of about 30° to 400° Celsius. The material chosen is preferably an alloy made from iron (Fe), nickel (Ni) and cobalt (Co). Suggested materials are Rodar, Fernico, Vacon (German), Dilver (French) and Nilo K (Great Britain). The coefficient of thermal expansion for borosilicate glass is about $46\times10^{-7}$ cm/cm/°C.

Thus, there has been shown and described an improved hermetically sealed enclosure for a thin film device and the method of making thereof. The metallic frame provides for rugged construction to protect the thin film device within and for simple assembly through the use of welding to join the parts together. The enclosure may be sealed at low temperatures in order to protect the integrity of the thin film layers. Finally, the glass to metal seals, adjacent the viewing point, will not deteriorate over time due to the matching of coefficients of thermal expansion of the materials bounding the seal.

While there have been shown and described what are at present considered the preferred embodiments of the invention, it will be obvious to those skilled in the art that various changes and modifications may be made therein without departing from the scope of the invention as defined by the appended claims.

What is claimed is:

1. A hermetically sealed enclosure for a thin film device, said enclosure comprising:

frame means;

a light transmitting, electrically insulated substrate having a thin film matrix positioned on one side thereof, said substrate having indentations therein and said thin film matrix including conductive contacts extending therefrom and into a respective one of said indentations, said contacts being supported by said substrate, said substrate being in contact with said frame means and made of a material having a coefficient of thermal expansion substantially similar to the material forming said frame means;

hermetic seal means adjacent said substrate and in contact with said frame means;

a pair of electrical conductors electrically coupled to said thin film matrix; and cover means hermetically sealed to said frame means, said cover means, said frame means, and said substrate defining a chamber therebetween wherein said thin film matrix is located, said cover means supporting said conductors extending therethrough.

2. The hermetically sealed enclosure according to claim 1 wherein each of said indentations is filled with a conductive adhesive that overlies said contact therein.

3. The hermetically sealed enclosure according to claim 2 wherein said electrical conductors are self-aligning with said contact when said conductors are disposed in said conductive adhesive.

4. The hermetically sealed enclosure according to claim 3 wherein said contacts and conductors are fixedly joined upon heating said enclosure and curing said adhesive.

5. The hermetically sealed enclosure according to claim 1 wherein said hermetic seal means adjacent said substrate includes a frit seal formed on an inner surface of said frame means and said hermetic seal between said cover means and said frame means is formed on an outer surface of said frame means.

6. A method of hermetically sealing a thin film device, said method comprising the steps of:

providing frame means;

sealing a plate to said frame means to form a hermetic seal;

disposing a light transmitting, electrically insulating substrate having indentations formed therein in contact with said frame means, said substrate being made of a material having a coefficient of thermal expansion substantially similar to the material forming said frame means;

forming a thin film matrix on one side of said substrate having said indentations, said thin film matrix having conductive contacts extending therefrom and into a respective one of said indentations, said indentations then being filled with a conductive adhesive;

securing cover means to said frame means, said cover means having a pair of electrical conductors extending therefrom and into said conductive adhesive upon securing said cover means, said cover means, said frame means and said substrate defining a chamber therebetween, said thin film matrix being located within said chamber;

heating said conductive adhesive for a predetermined period of time at a predetermined temperature thereby curing said adhesive and fixedly joining said contacts and conductors; and hermetically sealing said cover means and said frame means to define an enclosed thin film device.

7. The method of hermetically sealing a thin film device according to claim 6 wherein said predetermined temperature is in the range about 120° to 150° Celsius and said predetermined time is in the range of about 30 to 60 minutes, said time decreasing as said temperature increases.

8. The method of hermetically sealing a thin film device according to claim 6 wherein said indentations are made by ultrasonically dimpling said substrate, said indentations having a depth of about 0.010 inch to about 0.015 inch.

* * * * *